US006823804B2

(12) United States Patent
Arnell

(10) Patent No.: US 6,823,804 B2
(45) Date of Patent: Nov. 30, 2004

(54) INTERCHANGEABLE TABLE TOP

(76) Inventor: Holly K. Arnell, 68 Sherwood Dr., Morristown, NJ (US) 07960

( * ) Notice: Subject to any disclaimer, the term of this patent is extended or adjusted under 35 U.S.C. 154(b) by 6 days.

(21) Appl. No.: 10/055,730

(22) Filed: Oct. 25, 2001

(65) Prior Publication Data

US 2003/0041786 A1 Mar. 6, 2003

Related U.S. Application Data

(60) Provisional application No. 60/243,302, filed on Oct. 27, 2000.

(51) Int. Cl.[7] ..... A47B 13/08
(52) U.S. Cl. ..... 108/90; 108/13
(58) Field of Search ..... 108/11, 13, 90, 108/27, 161

(56) References Cited

U.S. PATENT DOCUMENTS

| | | | | | |
|---|---|---|---|---|---|
| 161,502 | A | * | 3/1875 | Gilbert | 273/284 |
| 1,738,429 | A | * | 12/1929 | Heyman | 108/186 |
| 1,916,435 | A | * | 7/1933 | Ott et al. | 108/90 |
| 2,003,834 | A | * | 6/1935 | Mitchell | 108/90 |
| 3,554,140 | A | * | 1/1971 | Homesberger | 108/90 |
| 3,583,337 | A | * | 6/1971 | Yokeley | 108/90 |
| 4,841,878 | A | * | 6/1989 | Kriegsman | 108/90 |
| 5,727,477 | A | * | 3/1998 | Kirkendall | 108/90 |
| 6,003,963 | A | * | 12/1999 | Grender | 312/204 |
| 6,367,392 | B2 | * | 4/2002 | Moore | 108/90 |
| 6,659,023 | B2 | * | 12/2003 | Saltzman et al. | 108/90 |

FOREIGN PATENT DOCUMENTS

JP 3-143611 * 6/1991

* cited by examiner

*Primary Examiner*—Jose V. Chen
(74) *Attorney, Agent, or Firm*—Bernhard P. Molldrem, Jr.

(57) ABSTRACT

An interchangeable table top arrangement has a frame and backer board that can fit over a pre-existing table top or can be attached to a pedestal and used as a main table top. The frame and backer board define a recess, and an interchangeable insert fits into this recess. A hook-and-eye material (i.e., Velcro®) or other suitable releasable attachment system hold the insert in place within the frame. Finger holes in the backer board facilitate separating the attachment system to change out the insert. The inserts may have designs imprinted on them, e.g., advertising, holiday theme material, or game boards.

12 Claims, 2 Drawing Sheets

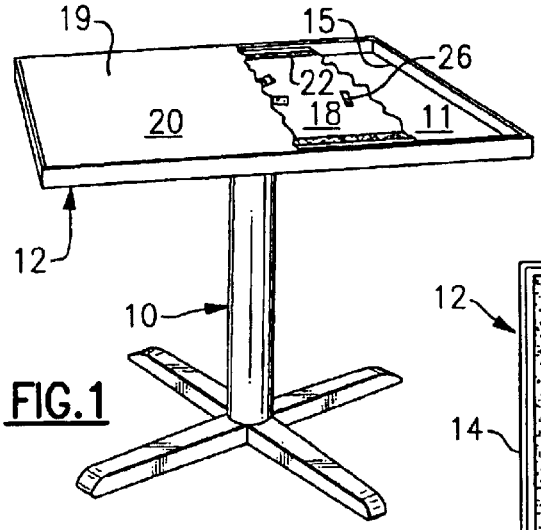
FIG.1
FIG.2
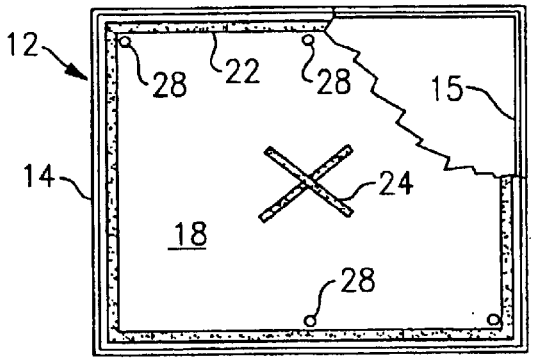
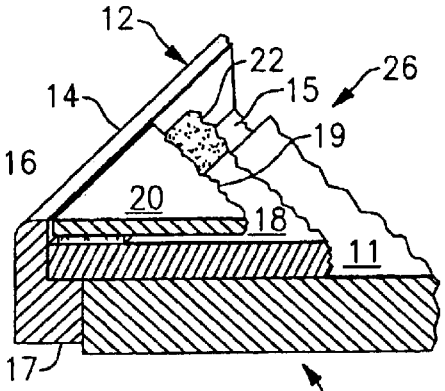
FIG.4
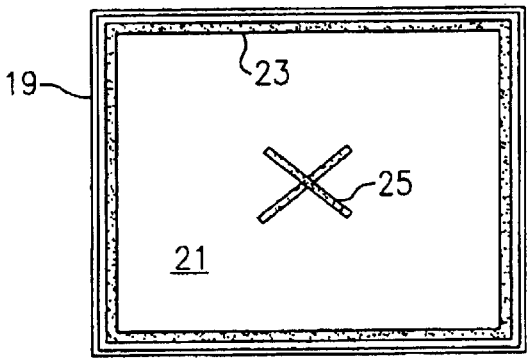
FIG.3

INTERCHANGEABLE TABLE TOP

This application claims the benefit of Provisional Application No. 60/243,302, filed Oct. 27, 2000.

BACKGROUND OF INVENTION

This invention is directed to flat horizontal support members, namely, tables, and more specifically to a simple system by which a conventional table or table base may be quickly and easily provided with an alternative or interchangeable table top surface appearance or configuration, whether ornamental, or functional, such as display advertising, game boards, instructional work stations, and the like.

The prior art is exemplified by U.S. Pat. No. 4,841,878 granted Jun. 27, 1989 to Elliot Kreigsman, which is directed to a see-through table top and the prior art described therein, namely U.S. Pat. No. 1,850,420 granted on Mar. 22, 1932 to S. J. Schuldt for "Game Table"; U.S. Pat. No. 3,001,843 granted on Sep. 26, 1961 to S. D. Davis for "Convertible Table"; and U.S. Pat. No. 3,227,105 granted on Jan. 4, 1966 to R. Reisdorff et al for "Table"; all of whose tables are relatively complex in construction; U.S. Pat. No. 3,212,952 granted on Oct. 19, 1965 to J. Turner for "Decorative Table" which provides an aesthetically pleasing table top; but one which must remain as set up by the manufacturer; and U.S. Pat. No. 2,833,609 granted on May 6, 1958 to C. J. Lawless for "Table Construction With Reversible Top" which is not only relatively complex in construction but only provides either one of only two table top configurations.

OBJECTS AND SUMMARY OF INVENTION

Broadly stated, the interchangeable table top according to the present invention, in one form, comprises a frame of a size and shape to fit over the top surface and around the edges of the top of an existing, conventional table. In one embodiment, an upwardly facing horizontal shoulder is spaced downwardly from the top edge of the frame and extends inwardly around the inner perimeter of the frame. A backer board is supported on the shoulder and permanently secured to the frame. The backer board in turn supports a replaceable and interchangeable table top insert member, which serves as a substrate for whatever ornamental, promotional (e.g., for advertising), entertainment, or other imaging as may be desired, with the image being applied to a top surface of the insert member. The frame defines a recess of given dimensions, and the insert has equal dimensions so that it fits rather precisely into the accommodating recess. The replaceable imaged table top insert member is releasably secured, using suitable releasable attaching means, to the backing board. Favorably, the top surface of the replaceable table top insert member is substantially flush with the edge of the frame. The backer board is provided with means for releasing the insert member from the backer board when it is desired to change the insert member out for a different insert member. In a preferred embodiment this can be constituted by one or more finger holes in the backer board. This feature facilitates separation of the releasably secured imaged table top. In an alternative form of the invention, the backer board may replace the conventional table top and be permanently secured to the table base. In such case, the backer board would be of suitable thickness to serve as a table top, and the pedestal base or other leg members would be fastened directly to the bottom surface of the backer board.

The above and other features and embodiments of this invention will become apparent from the following description of a preferred embodiment, which is to be read in conjunction with the accompanying Drawing figures in which corresponding parts are identified by the same reference numerals.

BRIEF DESCRIPTION OF THE DRAWING

FIG. 1 is a perspective elevational view of a conventional pedestal table having an interchangeable table top according to the present invention, shown with parts broken away to reveal hidden structures;

FIG. 2 is a top plan view of the table top frame, shown with parts broken away to reveal hidden structure;

FIG. 3 is a bottom plan view of the replaceable table top; and

FIG. 4 is a fragmentary vertical isometric section showing details of construction;

DETAILED DESCRIPTION OF THE PREFERRED EMBODIMENT

Figure 5:
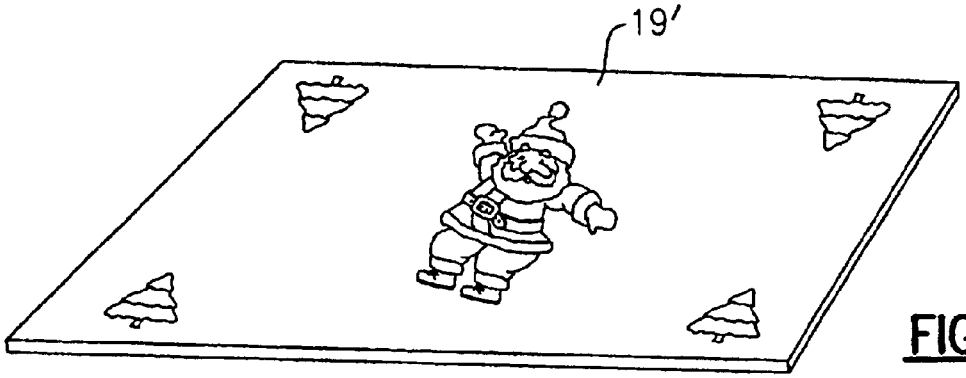
FIG. 5 is a perspective view of a table top insert on which is imprinted a holiday theme design.

Referring now to the Drawing, and initially to FIG. 1, a conventional pedestal table 10 has a normal or standard permanently attached table top 11, and an interchangeable table top 12 according to the present invention is installed on top of the aforementioned permanent table top 11. The interchangeable table top 12 includes a rigid frame 14 of a size and shape to fit over the top surface and around the edges of the standard top 11 of a conventional table with a slide fit. The invention is adapted to use with virtually any table. Although the invention is illustrated with respect to a rectangular table top, which is the most common shape, the table top arrangement may take the form of a table of any other standard geometric shape, i.e., circular, oval, elliptical, hexagonal, or the like. Non-standard shapes, e.g., horseshoe, semi-circular, or other shapes, are also possible. Although shown as a pedestal base table, this invention is equally applicable to multi-legged tables.

With further reference to FIGS. 2, 3, and 4, the frame 14 is shown to include an upwardly facing horizontal lip or shoulder 15 spaced downwardly from the top edge 16 of the frame and extending inwardly around the inner perimeter of the frame. In the assembled structure, the surface of lip or shoulder 15 lies in a common plane with the top surface of table top 11. The bottommost portion 17 of frame 14 below lip or shoulder 15 functions as a drop or skirt surrounding and engaging the side edges of the normal table top 11 with a slide fit. Frame 14 may be fabricated from wood, or it may be made from a molded, extruded or machined synthetic resinous plastic material, or a lightweight metal, such as aluminum or the like.

A rigid backer board 18 is supported within frame 14 supported on lips or shoulders 15 and permanently secured to the frame by means of nails or screws and/or adhesive. The dimensions of the backer board are the dimensions of table top 11 plus the widths of two lips or shoulders 15. The frame 14 and the backer board together define a recess 26, which in this embodiment is rectangular in shape. The recess 26 is of specific dimensions and is intended to receive an insert which will be described shortly. In the illustrated embodiment of the invention, the backer board 18 is intended to rest on the normal table top 11. Here, the lower part of the frame extends below the backer board 18 and defines a lower recess 27 that fits the permanent table top 11. In an alternative form, backer board 18 replaces conventional table top 11 and is permanently secured directly to a table base. In both forms it supports an interchangeable rigid planar table top insert 19 whose exposed upper surface 20 functions as a substrate for any of innumerable types of images, and whose bottom surface 22 overlies the back board, space therefrom by releasable fastening means. The "image" may be as simple as a plain over all color, or it might be an erasable surface on which indicia may be drawn and then removed, and the like. The table top insert 19 has the same dimensions as the recess 26, and fits snugly within the recess 26, surrounded by the frame 14.

There are first and second releasable attaching means disposed on the bottom of the insert 19 and on the upper surface of the backer board 18, and these may be complementary strips or patches of an interlocking book and loop type filamentary fastening material, such as that sold under the trademarks Velcro® and Scotchmate®. The releasable fastening means may be in the form of strips 22 and 23 attached, respectively to the top surface of backing board 18 and the bottom of surface 21 of table top 19. The strips 22 and 23 are desirably attached adjacent all peripheral edges of the backing board and table top insert, desirably supplemented by centrally located filamentary fastening means, such as the X-patterns 24 and 25 on the respective backing board and the table top insert. In this embodiment, the releasable fastening means must be arranged on the respective surfaces in complementary mirror image patterns so that they engage when the parts are pressed together. The patterns may have two-way or four-way symmetry so that the user does not have to be concerned with the orientation of the insert relative to the frame and backer-board portion. At least one finger hole, and preferably a plurality of finger holes 28 are provided through backer board 18, preferably along the edges and/or at the corners of the backer board 18 (see FIG. 2), to facilitate separation of the releasable fasteners when it is desired to replace or exchange an imaged table top insert 19. Favorably, the table tops can each be provided with a set of several interchangeable inserts 19. The variety of possible inserts is inexhaustible.

Instead of using complementary patterns of filamentary fastening strips on both the top side of backer board 18 and bottom side 21 of table top 19, the strips on one of the surfaces may be eliminated and replaced by a napped textile fabric covering the surface. When the top of the backing board 18 has a smooth glossy surface, suction cups may be used as the fastening means. Other releasable fastening means may be employed, such as magnetic strips or releasable mechanical fasteners.

The depth of lip or shoulder 15 is such that the combined thicknesses of the backer board 18, joined releasable fasteners 22–25 and imaged table top insert 19 cause the insert top surface 20 to be substantially flush with the top edge 16 of the frame 14, as in a high quality piece of furniture, disguising any appearance of being temporary or interchangeable. The outer top edge 16 of frame 14 is desirably rounded, as shown.

Figure 6:
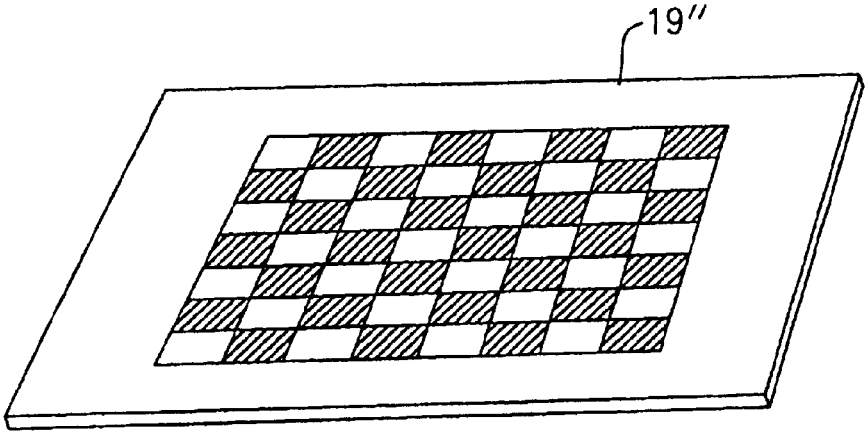
FIG. 6 is a perspective view of a table top insert on which is imprinted a game board design, i.e., a chess board.

The number of different images which may be applied to the top surface 20 of the interchangeable table top insert 19 is limitless. Examples include display advertising, abstract designs, holiday theme materials designs, such as Christmas theme images (See insert 19'—FIG. 5), play surfaces such as checker boards (See insert 19"—FIG. 6), or boards for such games as Parcheesi, Poker, Monopoly, etc., ornamental and decorative simulated wood and stone surfaces, sports schedules, etc. The table top of this invention is intended to be suited for commercial usage, such as food courts, lunchrooms, cafes, etc., but may be used in any environment where tables are used, such as game rooms, class rooms, or other environments. The principle of this invention provides a simple easy way of adapting the table tops to meet varying situational needs on a time sensitive and efficient basis. For example, the tables 10 can be arranged with holiday inserts 19' for a holiday party, and then quickly changed over for another event by changing out the inserts, for example using the inserts 19" for a chess tournament. The inserts 19 can be imprinted with designs that carry advertisements for local merchants, with the inserts 19 being changed over when the businesses change, or when advertising or promotional campaigns so dictate.

While the invention has been described with respect to a selected preferred embodiment, it should be recognized that the invention is not limited to that embodiment, and that many modifications and variations would be apparent to persons skilled in the art without departure from the scope and spirit of this invention, as defined in the appended claims.

I claim:

1. An interchangeable table top arrangement comprising:

a horizontal flat substrate;

a frame positioned on the periphery of said substrate and extending a predetermined distance above an upper surface of said substrate, the frame defining a recess of predetermined dimensions;

a flat interchangeable insert member having dimensions equal to the dimensions of said recess so as to fit therein and to be liftable out therefrom;

first removable attaching means disposed on an underside of said insert member and second removable attaching means disposed on an upper surface of said substrate, said first and second removable attaching means engaging one another for removably securing the insert member within said recess onto said substrate; and means extending through said substrate, but not extending through said insert, for disengaging said first and second removable attaching means from one another to permit change out of said insert member by lifting it.

2. An interchangeable table top arrangement according to claim 1 wherein said first and second removable engagement means include strips of interlocking hook-and-loop filamentary material.

3. An interchangeable table top arrangement according to claim 2 wherein at least some of said strips are located along edges of said insert member and along edges of said recess, respectively.

4. An interchangeable table top arrangement according to claim 3 wherein said strips additionally include strip members in matching X patterns on said substrate and on said insert member, respectively.

5. An interchangeable table top arrangement according to claim 1 wherein said means for disengaging includes at least one finger hole in said substrate.

6. An interchangeable table top arrangement according to claim 5 wherein said at least one finger hole is located along an edge of said substrate.

7. An interchangeable table top arrangement according to claim 5 wherein said at least one finger hole is located at a corner of said substrate.

8. An interchangeable table top arrangement according to claim 1 wherein said frame extends beneath said substrate to form a lower recess so that the arrangement may be fitted over an existing table top.

9. An interchangeable table top arrangement according to claim 1, wherein said insert member is provided with a theme design on its upper surface.

10. An interchangeable table top arrangement according to claim 1, wherein said insert member is provided with a game board design on its upper surface.

11. An interchangeable table top arrangement according to claim 1 wherein, when said insert member is in place in said recess, the upper surface of the insert member is substantially flush with an upper edge of said frame.

12. An interchangeable table top arrangement according to claim 1 wherein said insert is provided with an image formed on a top surface thereof.

* * * * *